US011326510B2

(12) United States Patent
Ninomiya et al.

(10) Patent No.: US 11,326,510 B2
(45) Date of Patent: May 10, 2022

(54) GENERAL PURPOSE ENGINE

(71) Applicant: HONDA MOTOR CO., LTD., Tokyo (JP)

(72) Inventors: Yusuke Ninomiya, Saitama (JP); Yuko Akamine, Saitama (JP); Yuji Oigawa, Saitama (JP); Shohma Higano, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/042,200

(22) PCT Filed: Mar. 30, 2018

(86) PCT No.: PCT/JP2018/013839
§ 371 (c)(1),
(2) Date: Sep. 28, 2020

(87) PCT Pub. No.: WO2019/187083
PCT Pub. Date: Oct. 3, 2019

(65) Prior Publication Data

US 2021/0115845 A1 Apr. 22, 2021

(51) Int. Cl.
*F02B 63/02* (2006.01)
*F02B 75/16* (2006.01)
(Continued)

(52) U.S. Cl.
CPC ..... *F02B 63/02* (2013.01); *F02B 75/16* (2013.01); *F02B 2075/027* (2013.01); *F02M 37/007* (2013.01)

(58) Field of Classification Search
CPC .... F02B 63/02; F02B 75/16; F02B 2075/027; F02B 77/13; F02M 37/0017; F02M 37/007
See application file for complete search history.

(56) References Cited

U.S. PATENT DOCUMENTS 5,483,931 A 1/1996 Stoll et al.
9,617,959 B2 * 4/2017 Kuwato ..... F02B 63/02
(Continued)

FOREIGN PATENT DOCUMENTS

EP 1149997 A2 10/2001
EP 1267056 A1 12/2002
(Continued)

OTHER PUBLICATIONS

Extended European Search Report issued in the EP Patent Application No. EP18911482.0, dated Jan. 15, 2021.
(Continued)

*Primary Examiner* — Syed O Hasan
(74) *Attorney, Agent, or Firm* — CKC & Partners Co., LLC

(57) ABSTRACT

Provided is a general purpose engine that has a small external appearance and can be placed in a stable posture even when inverted, and whereby labels attached to the upper surface thereof can be protected. The general purpose engine 1 comprises a shroud 4 covering an engine main body. The shroud 4 includes: a top cover 2 arranged in an upper section of the general purpose engine 1; and a bottom cover 3 arranged in a lower section of the general purpose engine 1. The top cover 2 has a pair of bridges 20, 20 formed so as to protrude from the upper surface of the top cover 2, constituting the apex of the top cover 2 and continually extending from the front surface of the top cover 2 to the rear surface thereof, across the upper surface.

8 Claims, 6 Drawing Sheets

(51) Int. Cl.
*F02B 75/02* (2006.01)
*F02M 37/00* (2006.01)

(56) References Cited

U.S. PATENT DOCUMENTS

| | | | | |
|---|---|---|---|---|
| 2002/0170523 | A1 | 11/2002 | Eberhardt et al. | |
| 2013/0068179 | A1 | 3/2013 | Nakamura | |
| 2013/0284126 | A1* | 10/2013 | Kimura | F01P 5/06 123/2 |
| 2015/0059662 | A1* | 3/2015 | Lan | F02B 63/048 123/2 |

FOREIGN PATENT DOCUMENTS

| | | | |
|---|---|---|---|
| JP | H1122462 | A | 1/1999 |
| JP | 2002303148 | A | 10/2002 |
| JP | 2012007482 | A | 1/2012 |
| JP | 2012178982 | A | 9/2012 |
| JP | 2013068118 | A | 4/2013 |
| JP | 2014148967 | A | 8/2014 |
| JP | 2015145622 | A | 8/2015 |
| JP | 2017053233 | A | 3/2017 |
| TW | I388715 | B | 3/2013 |
| WO | 2006017884 | A1 | 2/2006 |

OTHER PUBLICATIONS

The office action of the corresponding IN Patent Application No. IN202047046449, dated Jan. 15, 2021.

* cited by examiner

GENERAL PURPOSE ENGINE

TECHNICAL FIELD

The present invention relates to a general-purpose engine.

BACKGROUND ART

Conventionally, a general-purpose engine has been known which can be used as a driving source of a small working machine such as a weed trimmer (for example, refer to Patent Document 1). With such a weed trimmer, the general-purpose engine is mounted to a base end of a drive shaft having a blade mounted to the leading end.

Patent Document 1: Japanese Unexamined Patent Application, Publication No. 2017-53233

DISCLOSURE OF THE INVENTION

Problems to be Solved by the Invention

Incidentally, with a small working machine such as a weed trimmer, a high-output general-purpose engine despite being small size has been demanded. However, with a conventional general-purpose engine, a device has not been sufficiently made from the viewpoint of the external appearance of the general-purpose engine, relative to the relationship of tradeoff such as an increase in size when making higher output.

In addition, there are cases when placing the general-purpose engine in a state turned upside-down as when exchanging the blade of a weed trimmer. However, with conventional general-purpose engines, it has not been made in a form considering the stability of the posture when placing in a state turned upside-down. In addition, normally, when a label is attached to the top surface of the general-purpose engine, since the top surface tends to get scratched in a state turned upside-down, an improvement has also been demanded from the viewpoint of protection of labels.

The present invention has been made taking the above into account, and an object thereof is to provide an general-purpose engine which has an external form which appears small, as well as being able to be placed in a stable posture in a state turned upside-down, and can protect a label attached to the top surface.

Means for Solving the Problems

A first aspect of the present invention provides a general-purpose engine (for example, the general-purpose engine 1 described later) including a shroud (for example, the shroud 4 described later) which covers an engine main body (for example, the engine main body described later), in which the shroud is configured to include a top cover (for example, the top cover 2 described later) disposed at an upper part of the general-purpose engine, and a bottom cover (for example, the bottom cover 3 described later) disposed at a lower part of the general-purpose engine, and in which the top cover has a pair of bridge parts (for example, the bridge parts 20, 20 described later) which is formed so as to project from an upper surface (for example, the upper surface 21 described later) of the top cover and configure an apex of the top cover, and extends continuously from a front surface (for example, the front surface 22 described later) of the top cover until a back surface (for example, the back surface 23 described later) through the upper surface.

The first aspect of the present invention provides the pair of bridge parts constituting an apex of the top cover by projecting from the upper surface of the top cover, and extending continuously from the front surface of the top cover until the back surface through the upper surface. Even in a case of increasing the size due to raising output of the engine, and the width increasing, as a result of the line of sight being guided to the longitudinal direction by the pair of bridge parts, it thereby comes to give a slim impression in the shape as a whole, and seems to be small. In addition, since the apex of the top cover is configured from the pair of bridges, even in a case of placing the general-purpose engine in a state turned upside-down, the pair of bridge parts functions as a support part, and can secure a stable posture. At the same time, since the upper surface of the general-purpose engine will not directly contact the placement surface, it is possible to suppress scratching of the upper surface, whereby protection of labels attached to the upper surface is possible.

According to a second aspect of the present invention, it is preferable in the first aspect of the present invention for a surface part (for example, the surface part 201 described later) configuring a surface of the bridge part to have a tapered shape in which a width narrows moving upwards, in a front view of the general-purpose engine.

In the second aspect of the present invention, in a front view of the general-purpose engine, the surface part constituting the surface of each bridge part is made into a tapered shape in which the width narrows moving upwards. As a result of the line of sight being guided to the longitudinal direction by the pair of bridge parts having a tapered shape in which the width narrows moving upwards, it thereby comes to give a slim impression in the shape as a whole, and seems to be smaller.

According to a third aspect of the present invention, it is preferable in the first or second aspect of the present invention for an inside surface part (for example, the inside surface part 202 described later) configuring an inside surface linking a surface of the bridge part and an upper surface of the top cover to slope to an outer side as approaching the surface of the bridge part from the upper surface of the top cover, in a front view of the general-purpose engine.

In the third aspect of the present invention, the inside surface part constituting the inner surface linking the surface of each bridge part and the upper surface of the top cover is made to slope to the outer side as approaching the surface of the bridge part from the upper surface of the top cover, in a front view of the general-purpose engine. In the case of placing the general-purpose engine in a state turned upside-down, as a result of the force in the outside direction acting on the pair of bridge parts functioning as supports, it is thereby possible to secure a more stable posture.

According to a fourth aspect of the present invention, it is preferable in any of the first to third aspects of the present invention for the surface part configuring the surface of the bridge part to slope downwards as approaching to outside, in a front view of the general-purpose engine.

In the fourth aspect of the present invention, the surface part constituting the surface of each bridge part is made to slope downwards as approaching the outside, in the front view of the general-purpose engine. In the case of placing the general-purpose engine in a state turned upside-down, since it is possible to further decrease the contact area, a more stable posture can be secured, and an effect of more hardly being scratched is obtained.

Effects of the Invention

According to the present invention, it is possible to provide an general-purpose engine which has an external form which appears small, as well as being able to be placed in a stable posture in a state turned upside-down, and can protect a label attached to the top surface.

PREFERRED MODE FOR CARRYING OUT THE INVENTION

Hereinafter, an embodiment of the present invention will be explained in detail while referencing the drawings.

Figure 1:
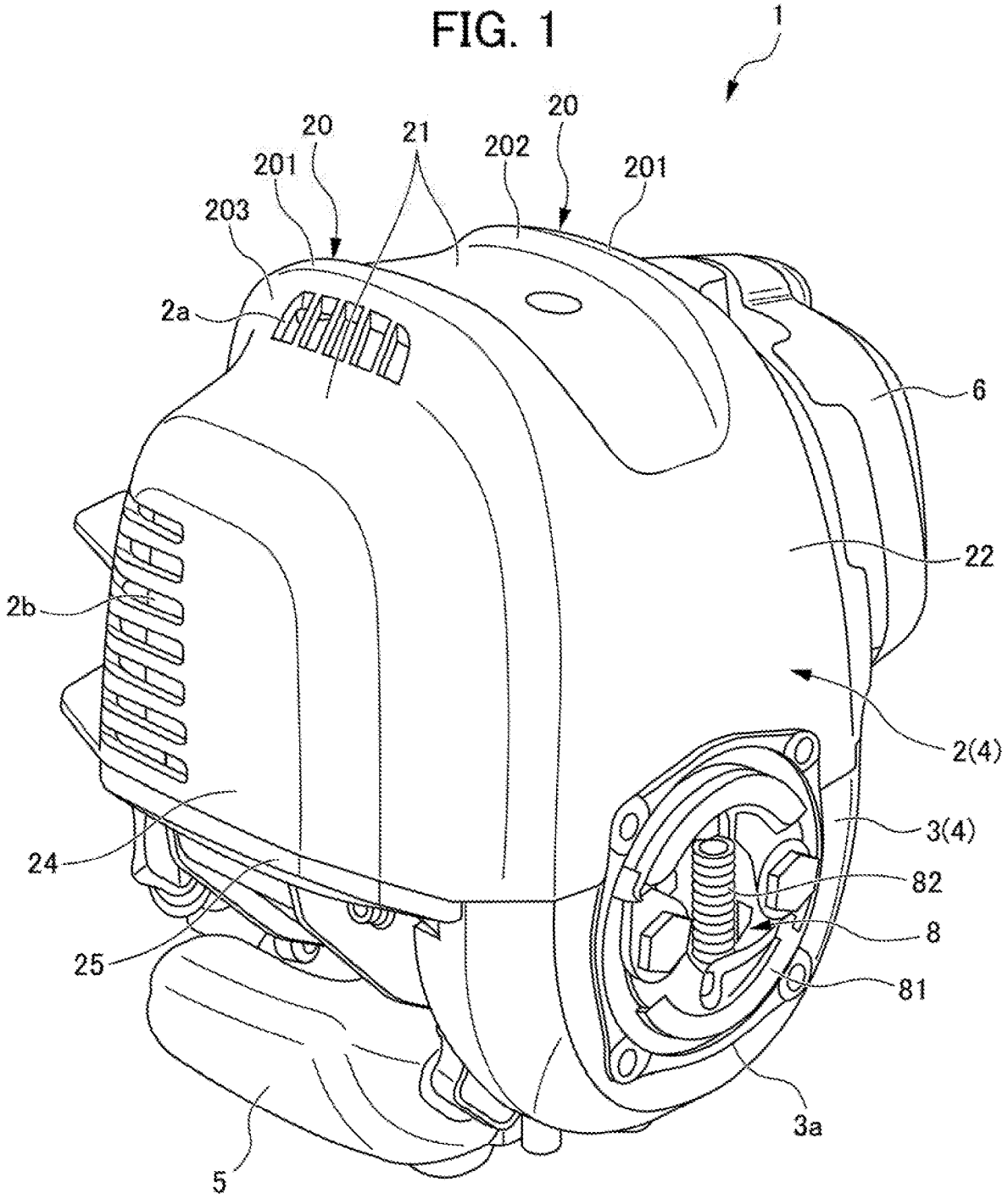
FIG. 1 is a forward perspective view of a general-purpose engine according to an embodiment of the present invention.
Figure 2:
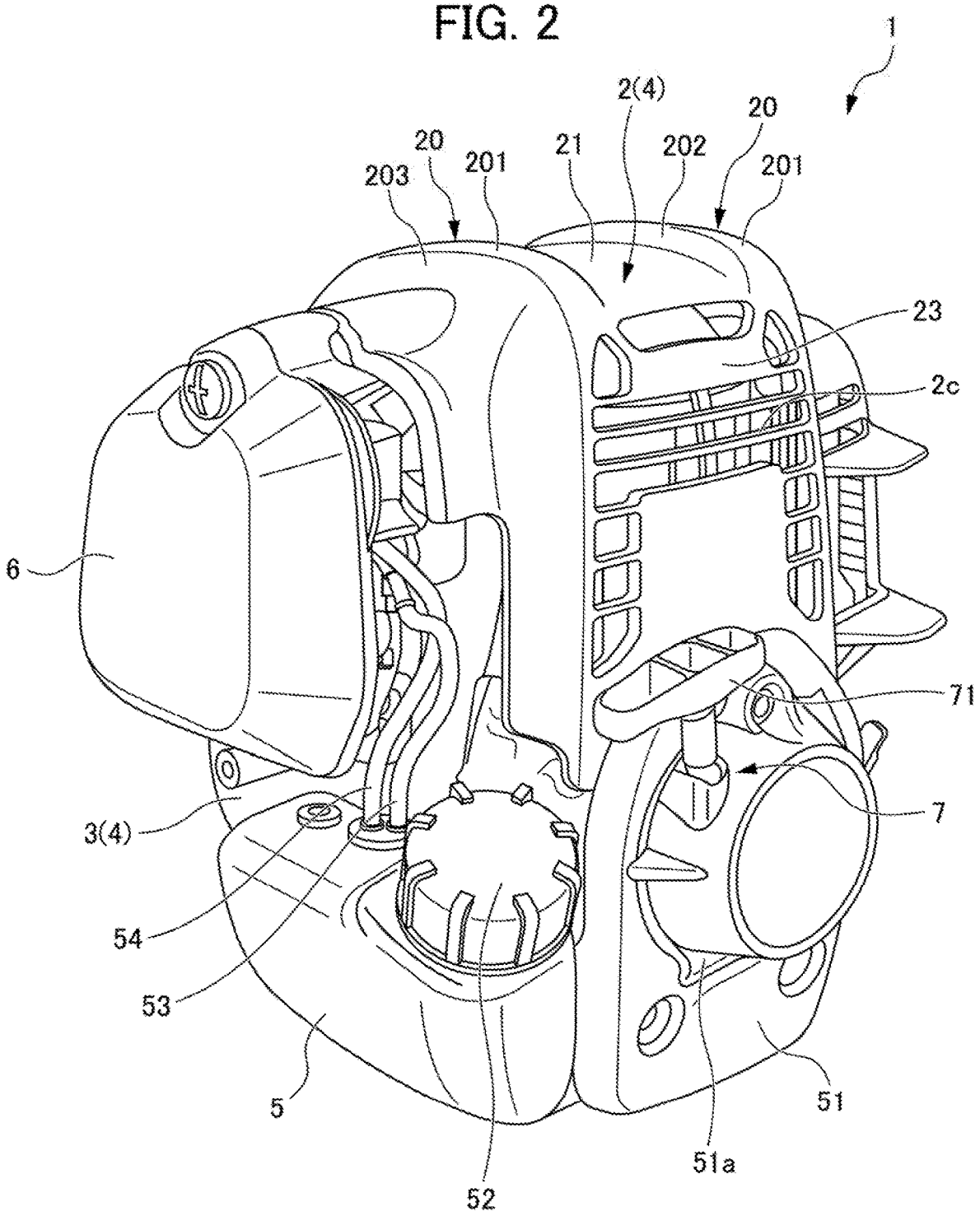
FIG. 2 is a rear perspective view of a general-purpose engine according to an embodiment of the present invention.
Figure 3:
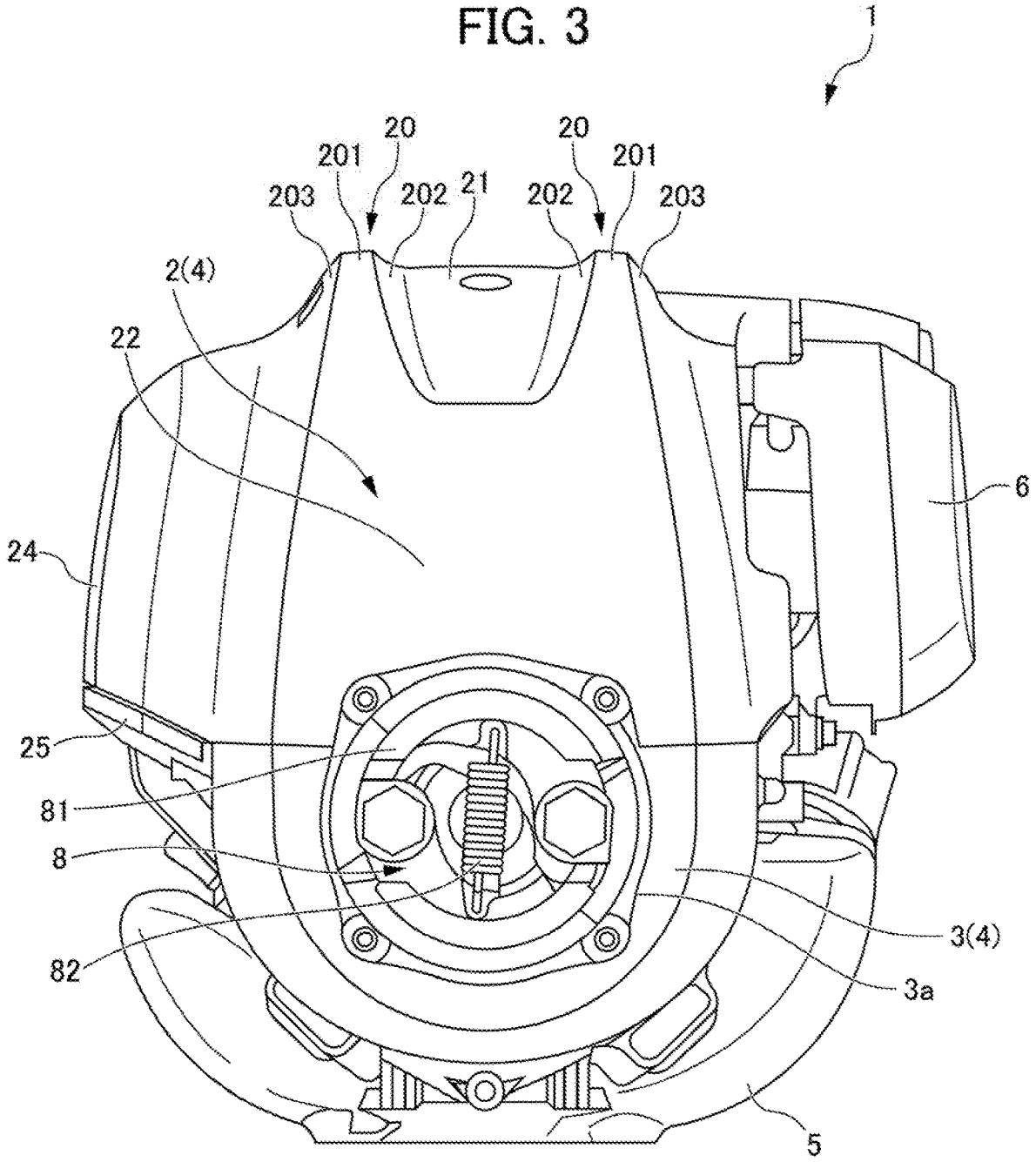
FIG. 3 is a front view of a general-purpose engine according to an embodiment of the present invention.
Figure 4:
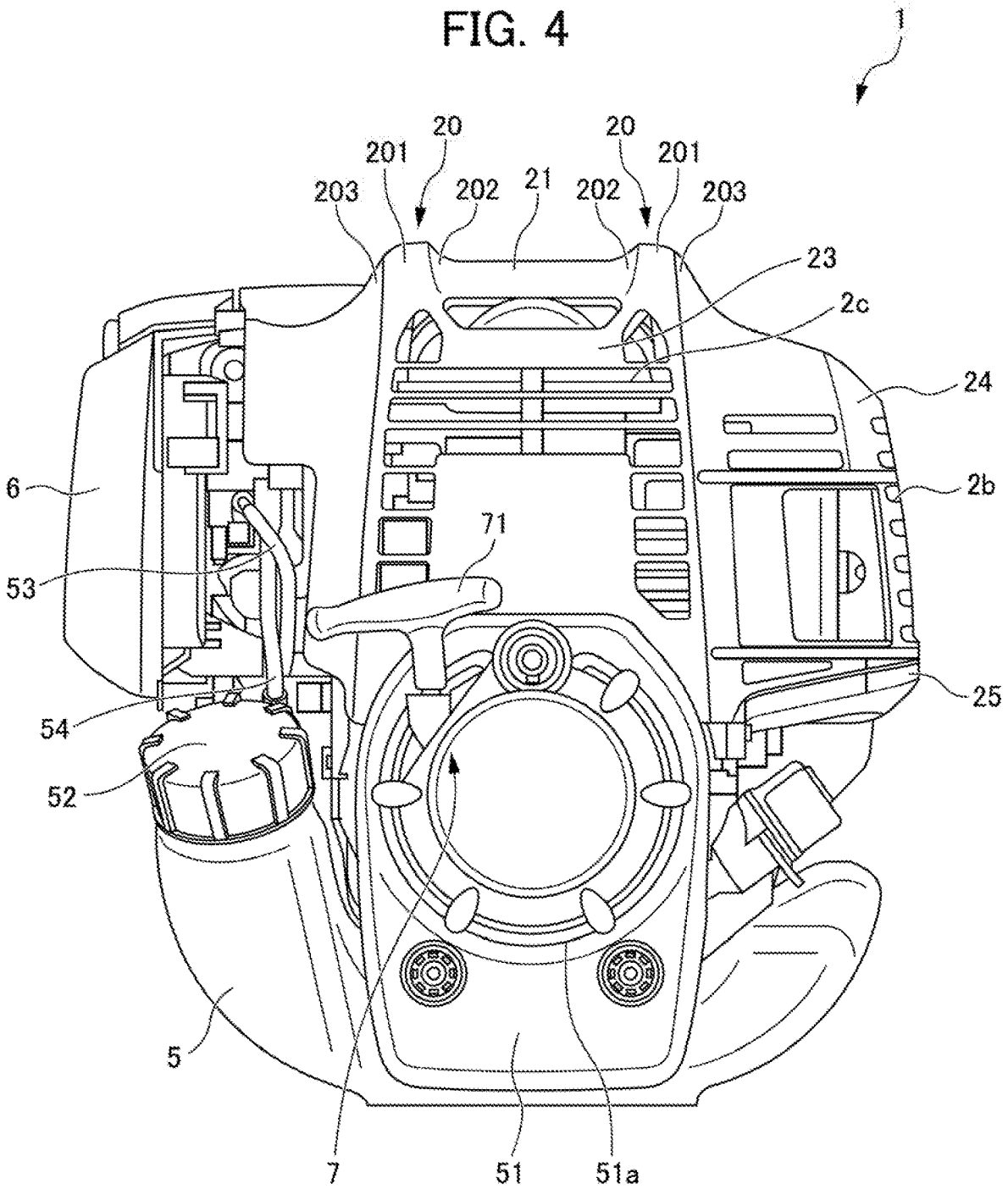
FIG. 4 is a rear view of a general-purpose engine according to an embodiment of the present invention.
Figure 5:
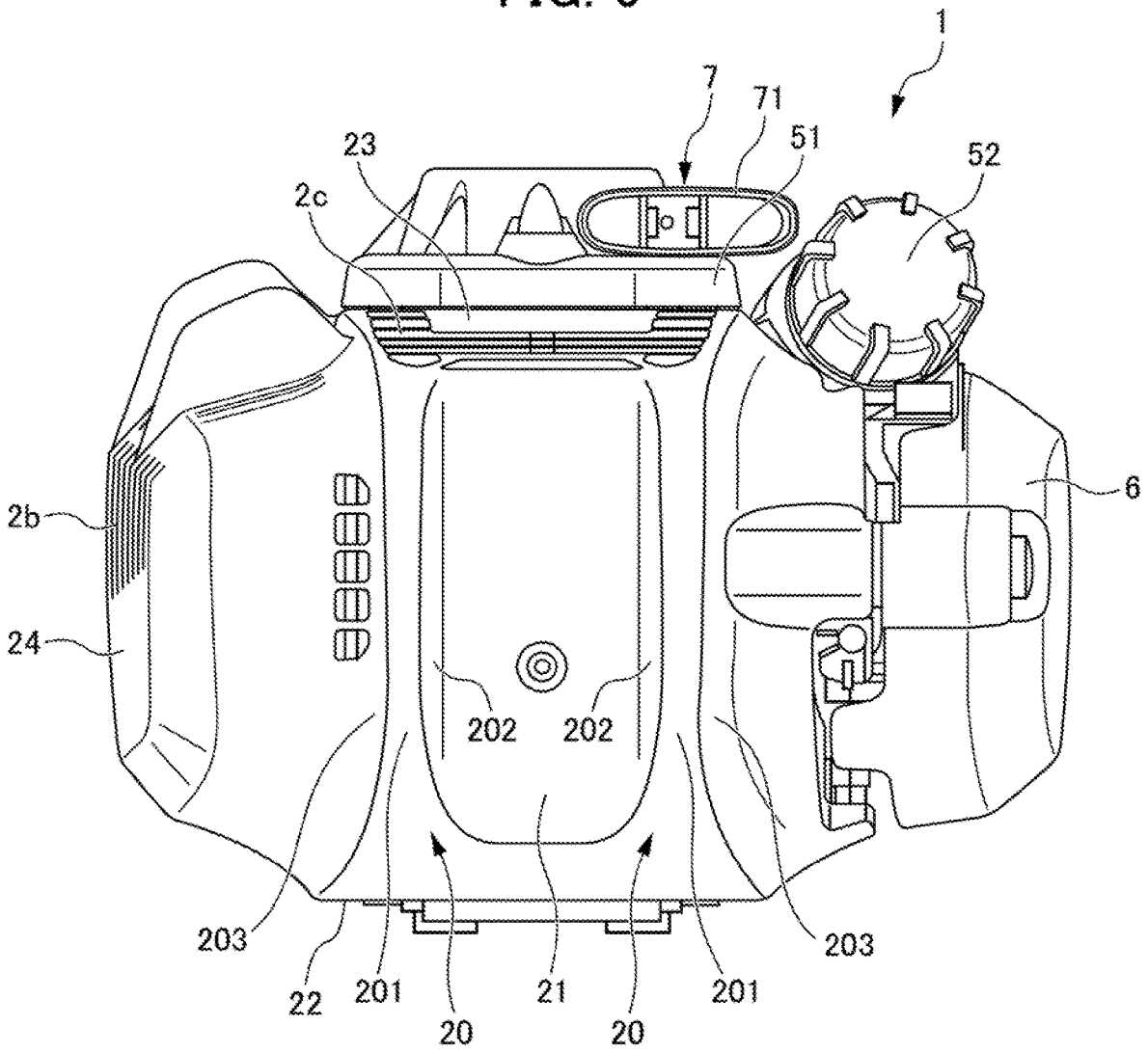
FIG. 5 is a plan view of a general-purpose engine according to an embodiment of the present invention.

FIG. 1 is a forward perspective view of a general-purpose engine 1 according to an embodiment of the present invention. FIG. 2 is a rear perspective view of a general-purpose engine according to an embodiment of the present invention. FIG. 3 is a front view of a general-purpose engine according to an embodiment of the present invention. FIG. 4 is a rear view of a general-purpose engine according to an embodiment of the present invention. FIG. 5 is a plan view of a general-purpose engine according to an embodiment of the present invention. It should be noted that general-purpose engine indicates a multipurpose engine for which the application is not specified, such as for automobiles or motorcycles.

The general-purpose engine 1 according to the present embodiment can be used as a driving source of a small-scale working machine such as a weed trimmer, for example. The general-purpose engine 1 is a four-stroke engine of higher horsepower than conventional, irrespective of its small scale. The general-purpose engine 1 can run even if tilted 360 degrees, and is suitable as the drive source of handheld work machines such as a weed trimmer. In the case of being used in a weed trimmer, the general-purpose engine 1 is attached to a base end of a drive shaft to which a blade is attached at the leading end.

As shown in FIGS. 1 to 5, the general-purpose engine 1 includes: a shroud 4 configured to include a top cover 2, bottom cover 3 and inner cover 25; a fuel tank 5; an air cleaner 6; a recoil starter 7; a tank guard 51; a refilling cap 52; a fuel tube 53; a fuel return tube 54; and a centrifugal clutch 8.

The top cover 2 is arranged at the upper part of the general-purpose engine 1, and is a cover which covers the upper part of the engine main body (cylinder block, crank case, etc.). The top cover 2 is a cover of substantially dome shape in which the bottom is open, and is formed so as to cover the cylinder block, etc. in which the cylinder and cylinder head (neither illustrated) are formed integrally. In addition, on one side among both sides of the general-purpose engine 1 (left side in the drawing), the exhaust port and cannister muffler (neither illustrated) are arranged to be accommodated, and the top cover 2 is formed so as to cover these. It should be noted that the cannister muffler is arranged between the fuel tank described later and the engine main bod, and reduces the sound (exhaust sound) generated upon exhaust being emitted to outside and sound (intake sound) generated upon air being drawn into the intake plumbing, as well as preventing transpiration by reducing the pressure and temporarily capturing thermally expanded vaporized fuel.

A plurality of ventilation ports is formed in the top cover 2. More specifically, a top ventilation port 2*a*, side ventilation port 2*b* and back ventilation port 2*c* are formed. This top ventilation port 2*a*, side ventilation port 2*b* and back ventilation port 2*c* are used in the release of heat generated from the engine main body, particularly the cylinder and exhaust-system component. In addition, the cooling air flow from the cooling fan (not illustrated), after being utilized in the cooling of the engine main body, etc., is discharged from this plurality of ventilation ports.

The top ventilation port 2*a* is formed in an outside surface part 203 constituting the outside surface of a bridge part 20 described later, on the left side of the general-purpose engine 1 to which the above-mentioned exhaust system is arranged. The top ventilation port 2*a* is configured by a plurality of notches extending obliquely upwards from an outer side towards the inner side. The side ventilation port 2*b* is formed in a left-side surface 24 of the general-purpose engine 1 to which the above-mentioned exhaust system is arranged. The side ventilation port 2*b* is configured by a plurality of notches extending in the front/rear direction on the back side of the left-side surface 24. The back ventilation port 2*c* is formed along a wide range of the back surface 23 of the top cover 2. The back ventilation port 2*c* is configured by a plurality of notches of different length extending in the left/right direction.

In addition, in the upper surface 21 of the top cover 2, a pair of bridge parts 20, 20 is formed. This pair of bridge parts 20, 20 is described in detail at a later stage.

The bottom cover 3 is arranged at the lower part of the general-purpose engine 1, and is a cover which covers the lower part of the engine main body. The bottom cover 3 is a cover of substantially semicircular shape in the front view of the general-purpose engine 1, and is formed so as to cover the cooling fins provided to a flywheel which is connected to rotate with the crankshaft (not illustrated), the crank case (not illustrated) which is connected to the above-mentioned cylinder block, etc. It should be noted that the flywheel makes it possible to achieve smooth low speed rotation of the general-purpose engine 1 having a small number of cylinders using the inertia during rotation. In the present embodiment, by a plurality of cooling fins being formed at the circumferential edge of this flywheel, the cooling fan is configured.

In the front surface side of the bottom cover 3, a connection hole 30 to which the drive shaft of the weed trimmer (not illustrated) is connected is formed. Inside this connection hole 30, the centrifugal clutch 8 which engages or disengages the drive shaft by only an increase/decrease in rotation speed of the crank shaft is arranged, and the drive shaft is engaged to the crankshaft via this centrifugal clutch 8. It should be noted that, with the centrifugal clutch 8, the torque is transmitted by the clutch shoe 81 rotating together with the crankshaft being pressed against the clutch drum on the drive shaft by way of centrifugal force, and the torque transmission is disengaged by the clutch shoe 81 being distanced from the clutch drum by way of the resilience of a spring 82 as the rotation speed of the crankshaft declines and centrifugal force weakens.

As explained above, the shroud 4 configured to include the top cover 2, bottom cover 3 and inner cover 25 is formed so as to cover the engine main body consisting of the cylinder block in which the cylinder and cylinder head are formed integrally, and the crank case which is coupled to this cylinder block. The shroud 4 is configured from a resin member, and is fixed by bolts to the engine main body. The shape of this shroud 4, particularly the shapes of the top cover 2 and bottom cover 3, mainly constitutes the external shape of the general-purpose engine 1.

The fuel tank 5 is arranged at a lower part of the general-purpose engine 1. The fuel tank 5 constitutes the overall lower part of the general-purpose engine 1, and extends substantially in an arc shape in a front view of the general-purpose engine 1. Laterally on the intake side to which the air cleaner 6 is arranged, among both sides of the general-purpose engine 1 (right side in drawing), a refilling cap 52 which blocks the fuel filling opening, a fuel tube 53 which supplies fuel to the engine main body, and a fuel return tube 54 which circulates fuel to the fuel tank 5 are arranged at the fuel tank 5. A tank guard 51 which is a plate-shaped protective member covering the back surface side of the fuel tank 5, and extending in the up/down direction at the central portion in the left/right direction of the general-purpose engine 1 is arranged at the back surface side of the fuel tank 5. In this tank guard 51, mounting holes 51*a* for mounting the recoil starter 7 are formed. It should be noted that the recoil starter 7 is configured to include a pulley (not illustrated) in addition to a grip 71, a rope which is wound around the pulley and connected to the grip 71, etc., and causes the general-purpose engine 1 to start by giving rotational force to the crankshaft by the manipulation of the grip 71 by the user.

The air cleaner 6 is arranged at a side of the intake side among both sides of the general-purpose engine 1 (right side in the drawing). The air cleaner 6 is connected to an upstream side of a carburetor (not illustrated), and purifies the intake air.

Next, the structure of the upper part of the top cover 2 of the general-purpose engine 1 according to the present embodiment will be explained in detail by referencing FIG. 6.

Figure 6:
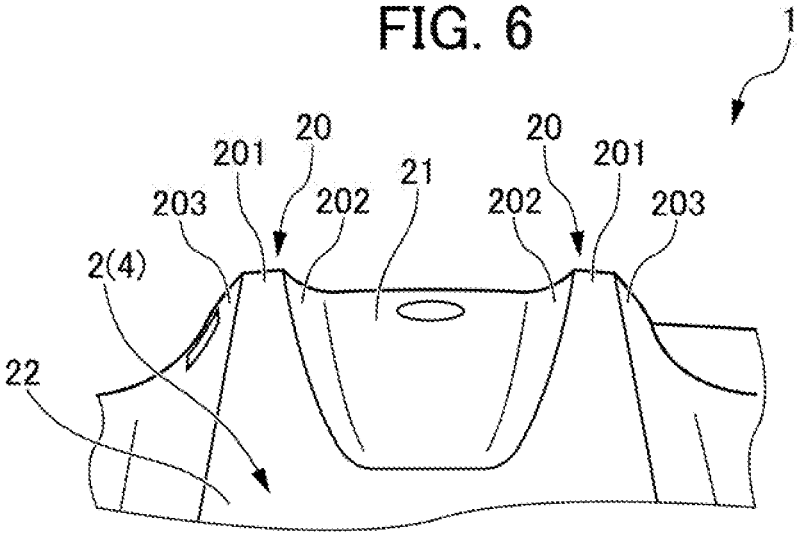
FIG. 6 is a partially enlarged view of an upper part of a general-purpose engine according to an embodiment of the present invention.

FIG. 6 is a partial enlarged view of an upper part of the general-purpose engine 1 according to the present embodiment. As shown in FIG. 6, the top cover 2 of the general-purpose engine 1 according to the present embodiment has the pair of bridge parts 20, 20 arranged opposing the upper surface 21 thereof. This pair of bridge parts 20, 20 has symmetrical shapes to each other relative to a central part of the upper surface 21 of the top cover 2.

The pair of bridge parts 20, 20 is formed so as to project from the upper surface 21 of the top cover 2, and constitutes an apex of the top cover 2. In addition, this pair of bridge parts 20, 20 extends to connect from the front surface 22 of the top cover 2 until the back surface 23 through the upper surface 21. In other words, the front surface 22 and back surface 23 of the top cover 2 are bridged by this pair of bridge parts 20, 20.

The pair of bridge parts 20, 20 respectively has: a surface part 201 constituting the surface thereof; and an inside surface part 202 constituting an inner surface and an outside surface part 203 constituting the outer surface, which link the surface part 201 and the upper surface 21 of the general-purpose engine 1. This pair of bridge parts 20, 20 is arranged opposingly in substantially parallel in a plan view of the general-purpose engine 1, as shown in FIG. 5.

The surface part 201 constituting the surface of each bridge part 20 is continuous with the front surface 22 of the top cover 2 without a level step, and is also continuous with the back surface 23 of the top cover 2 without a level step. The surface part 201, in a front view of the general-purpose engine 1, has a tapered shape in which the width narrows moving upwards. Similarly, also in the back view of the general-purpose engine 1, it has a tapered shape in which the width narrows moving upwards. For this reason, in a plan view of the general-purpose engine 1 as shown in FIG. 5, in the pair of bridge parts 20, 20, the width dimension increases towards the front surface 22 side, and similarly, the width dimension increases towards the back surface 23 side.

In addition, the surface part 201 constituting the surface of each bridge part 20 slopes downwards as approaching the outside, in a front view of the general-purpose engine 1. In other words, the surface parts 201, 201 of the pair of bridge parts 20, 20 are positioned higher towards the inside and positioned lower towards the outside. In the case of placing the general-purpose engine 1 upside down, both inside portions of the surface parts 201, 201 of the pair of bridge parts 20, 20 come to contact the placement surface preferentially.

The inside surface part 202 constituting the inner surface linking the surface of each bridge part 20 and the upper surface 21 of the top cover 2 slopes to the outer side as approaching the surface of the bridge part 20 from the upper surface 21 of the general-purpose engine 1, in a front view of the general-purpose engine 1. In other words, the inside surface parts 202, 202 of the pair of bridge parts 20, 20 are formed so as to separate from each other as approaching towards the surface of each bridge part 20 from the upper surface 21 of the top cover 2.

The outside surface part 203 constituting the outside surface linking the surface of each bridge part 20 and the upper surface 21 of the top cover 2 slopes downwards towards the outside. A much sharper and slimmer external shape thereby comes to be obtained.

The effects exerted by the general-purpose engine 1 according to the present embodiment equipped with the above configuration will be explained below by referencing FIG. 7. Herein, FIG. 7 is a view showing an aspect of the general-purpose engine 1 according to the present embodiment when placing in a state turned upside-down.

The present embodiment provides the pair of bridge parts 20, 20 constituting an apex of the top cover 2 by projecting from the upper surface 21 of the top cover 2, and extending continuously from the front surface 22 of the top cover 2 until the back surface 23 through the upper surface 21. Even in a case of increasing the size due to raising output of the general-purpose engine 1, and the width increasing, as a result of the line of sight being guided to the longitudinal direction by the pair of bridge parts 20, 20, it thereby comes to give a slim impression in the shape as a whole, and seems to be small.

Figure 7:
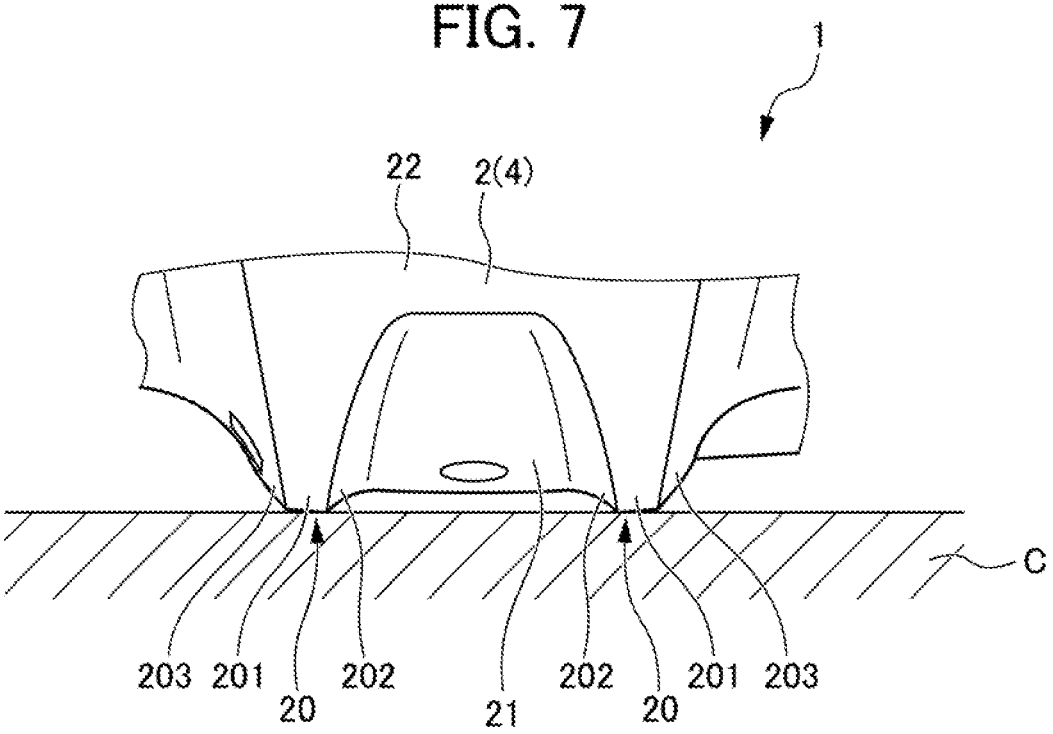
FIG. 7 is a view showing an aspect of a general-purpose engine according to an embodiment of the present invention when placing in a state turning upside-down.

In addition, since the apex of the top cover 2 is configured from the pair of bridges 20, 20, even in a case of placing the general-purpose engine 1 on a ground plane C in a state turned upside-down as shown in FIG. 7, the pair of bridge parts 20, 20 functions as a support part, and can secure a stable posture. At the same time, since the upper surface 21 of the general-purpose engine 1 will not directly contact the placement surface, it is possible to suppress scratching of the upper surface 21, whereby protection of labels attached to the upper surface 21 is possible.

In addition, according to the present embodiment, in a front view of the general-purpose engine 1, the surface part 201 constituting the surface of each bridge part 20 is made into a tapered shape in which the width narrows moving upwards. As a result of the line of sight being guided to the longitudinal direction by the pair of bridge parts 20, 20 having a tapered shape in which the width narrows moving upwards, it thereby comes to give a slim impression in the shape as a whole, and seems to be smaller.

In addition, according to the present embodiment, the inside surface part 202 constituting the inner surface linking the surface of each bridge part 20 and the upper surface 21 of the top cover 2 is made to slope to the outer side as approaching the surface of the bridge part 20 from the upper surface 21 of the top cover 2, in a front view of the general-purpose engine 1. In the case of placing the general-purpose engine 1 on the ground surface C in a state turned upside-down as shown in FIG. 7, as a result of the force in the outside direction acting on the pair of bridge parts 20, 20 functioning as supports, it is thereby possible to secure a more stable posture.

In addition, according to the present embodiment, the surface part 201 constituting the surface of each bridge part 20 is made to slope downwards as approaching the outside, in the front view of the general-purpose engine 1. In the case of placing the general-purpose engine 1 in a state turned upside-down as shown in FIG. 7, since it is possible to further decrease the contact area with the ground surface C, a more stable posture can be secured, and an effect of more hardly being scratched is obtained.

It should be noted that the present invention is not to be limited to the above-mentioned embodiment, and that modifications and improvements within a scope which can achieve the objects of the present invention are encompassed by the present invention.

EXPLANATION OF REFERENCE NUMERALS

1 general-purpose engine
2 top cover
3 bottom cover
4 shroud
20 bridge part
21 upper surface
22 front surface
23 back surface
201 surface part
202 inside surface part
203 outside surface part

The invention claimed is:

1. A general-purpose engine comprising a shroud which covers at least part of an engine main body, wherein the shroud is configured to include a top cover disposed at an upper part of the general-purpose engine, and a bottom cover disposed at a lower part of the general-purpose engine, wherein the top cover has a pair of bridge parts each formed so as to project from an upper surface of the top cover and configure an apex of the top cover, and each extending continuously from a front surface of the top cover until a back surface through the upper surface, wherein the pair of bridge parts directly contacts a placement surface of a placement location, when placing in a state turned upside-down;

wherein each of the bridge parts has an uppermost surface part, the uppermost surface part being substantially flat for a predetermined distance along a direction of extension of the bridge part, such that when the general-purpose engine is turned upside-down and the uppermost surface part is in direct contact with the placement surface, the general-purpose engine is secured in a stable posture;

wherein the bridge part has a first portion in which a width dimension increases as approaching a front surface of the general-purpose engine, a second portion in which a width dimension increases as approaching a back surface of the general-purpose engine, the width dimension being along a direction substantially perpendicular to the direction of extension of the bridge part, and a third portion between the first and second portions; and wherein the uppermost surface part is substantially flat for a majority of the third portion of the bridge part between the first and second portions.

2. The general-purpose engine according to claim 1, wherein the bridge part has a tapered shape in which a width narrows moving upwards, in a front view of the general-purpose engine.

3. The general-purpose engine according to claim 1, wherein an inside surface part configuring an inside surface of the bridge part slopes as approaching the uppermost surface part of the bridge part from the upper surface of the top cover, in a front view of the general-purpose engine.

4. The general-purpose engine according to claim 1, wherein the uppermost surface part of the bridge part slopes downwards as approaching an outer side of the top cover, in a front view of the general-purpose engine.

5. The general-purpose engine according to claim 1, wherein the bridge part has a portion in which a width dimension increases as approaching a front surface of the general-purpose engine, and a portion in which a width dimension increases as approaching a back surface of the general-purpose engine.

6. The general-purpose engine according to claim 1, wherein an outside surface part linking the uppermost surface part of the bridge part and the upper surface of the top cover slopes downwards to an outer side of the top cover.

7. A general-purpose engine comprising a shroud which covers at least part of an engine main body, wherein the shroud is configured to include a top cover disposed at an upper part of the general-purpose engine, and a bottom cover disposed at a lower part of the general-purpose engine, wherein the top cover has a pair of bridge parts each formed so as to project from an upper surface of the top cover and configure an apex of the top cover, and each extending continuously from a front surface of the tap cover until a back surface through the upper surface, wherein each of the bridge parts directly contacts a placement surface of a placement location, when placing in a state turned upside-down, wherein the engine main body has a muffler connected to a cylinder, wherein the general-purpose engine has a cooling mechanism which cools the engine main body, wherein the cooling mechanism includes a cooling fan v which generates a cooling air flow by rotating, and wherein a top ventilation port is formed in the pair of the bridge parts an outside surface part linking an uppermost surface part, which directly contacts the placement surface of the placement location, of the bridge part provided to a side of the muffler, and the upper surface of the top cover.

8. The general-purpose engine according to claim 7, further comprising an air cleaner disposed at a right side of the top cover of the shroud, in a front view of the general-purpose engine; and wherein the top ventilation port is formed in the outside surface part of one of the bridge parts, the outside surface part of said one of the bridge parts faces away from the air cleaner.

* * * * *